US010233847B2

(12) United States Patent
Behrendt

(10) Patent No.: US 10,233,847 B2
(45) Date of Patent: Mar. 19, 2019

(54) METHOD FOR CONTROLLING A FUEL DELIVERY SYSTEM

(71) Applicant: CONTINENTAL AUTOMOTIVE GmbH, Hannover (DE)

(72) Inventor: Gerald Behrendt, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/567,914

(22) PCT Filed: Apr. 25, 2016

(86) PCT No.: PCT/EP2016/059159

§ 371 (c)(1),
(2) Date: Oct. 19, 2017

(87) PCT Pub. No.: WO2016/173979

PCT Pub. Date: Nov. 3, 2016

(65) Prior Publication Data

US 2018/0087458 A1 Mar. 29, 2018

(30) Foreign Application Priority Data

Apr. 27, 2015 (DE) ..... 10 2015 207 700

(51) Int. Cl.

| | |
|---|---|
| ***F02D 1/02*** | (2006.01) |
| ***F02D 41/38*** | (2006.01) |
| *F02D 41/24* | (2006.01) |
| *F02D 41/30* | (2006.01) |

(52) U.S. Cl.

CPC ..... *F02D 1/02* (2013.01); *F02D 41/3836* (2013.01); *F02D 41/3854* (2013.01); *F02D 41/2432* (2013.01); *F02D 41/3082* (2013.01); *F02D 2200/0602* (2013.01); *F02D 2200/0604* (2013.01); *F02D 2200/0614* (2013.01)

(58) Field of Classification Search

CPC .... F02D 1/02; F02D 41/3082; F02D 41/3836; F02D 2200/0602; F02D 2200/0604; F02D 2200/0614

USPC ..... 123/497

See application file for complete search history.

(56) References Cited

U.S. PATENT DOCUMENTS

| | | | | |
|---|---|---|---|---|
| 2006/0021598 | A1* | 2/2006 | Nomura | F02D 41/3094 123/446 |
| 2007/0246021 | A1 | 10/2007 | Takayanagi et al. | |
| 2010/0275679 | A1 | 11/2010 | Wang et al. | |
| 2013/0327297 | A1* | 12/2013 | Sgatti | F02D 41/2467 123/456 |

FOREIGN PATENT DOCUMENTS

| | | |
|---|---|---|
| DE | 101 55 249 | 4/2003 |
| DE | 103 00 928 | 10/2004 |

(Continued)

*Primary Examiner* — Mahmoud Gimie
(74) *Attorney, Agent, or Firm* — Cozen O'Connor

(57) ABSTRACT

A method for controlling a fuel delivery system of an internal combustion engine, having a fuel delivery pump that is driven by an electric motor. The pressure that prevails in the fuel delivery system is determined by a volume difference between the fuel quantity delivered by the fuel delivery pump and the fuel requirement of the internal combustion engine and/or of the fuel delivery system.

10 Claims, 2 Drawing Sheets

(56) References Cited

FOREIGN PATENT DOCUMENTS

| | | |
|---|---|---|
| DE | 10 2007 033 858 | 1/2009 |
| DE | 10 2010 027 839 | 10/2011 |
| EP | 1 832 737 | 9/2007 |

* cited by examiner

METHOD FOR CONTROLLING A FUEL DELIVERY SYSTEM

CROSS REFERENCE TO RELATED APPLICATIONS

This is a U.S. national stage of application No. PCT/EP2016/059159, filed on Apr. 25, 2016. Priority is claimed on German Application No. DE102015207700.4, filed Apr. 27, 2015, the content of which is incorporated here by reference.

BACKGROUND OF THE INVENTION

1. Field of the Invention

The invention relates to a method for controlling a fuel delivery system of an internal combustion engine, having a fuel delivery pump driven by electric motor.

2. Description of the Prior Art

Fuel delivery pumps are used in fuel delivery systems of motor vehicles to meet the fuel requirement of the internal combustion engine. In addition, the operation of additional assemblies, such as suction jet pumps, is made possible by the fuel delivered by way of the fuel delivery pump.

In order to make a precise control of the fuel delivery pump possible, the pressure in the fuel delivery system is required as a relevant variable. The determination of the pressure can take place in a wide variety of ways.

Apparatuses are known in the prior art, which provide a dedicated pressure sensor that detects the pressure in the fuel delivery system. Depending on the configuration of the fuel delivery system, a plurality of pressure sensors can also be installed to determine the pressure at different locations. In the case of gasoline operated motor vehicles, the fuel pressure sensor is typically located in the feed line; it can be mounted there in the vicinity of the fuel delivery pump or in the region of the feed line on the high pressure pump of the internal combustion engine. There is typically a fuel return line only in diesel operated motor vehicles; a fuel pressure sensor can also be provided on the return line there. Therefore, the pressure determination can take place upstream of the fuel delivery pump and/or downstream of the fuel delivery pump.

It is a disadvantage of said apparatuses in the prior art that the sensors are additional structural components that have to be integrated into the fuel delivery system. The fuel delivery system becomes more complex and more expensive as a result. Furthermore, the sensors have to be connected to the vehicle electronics via an additional branch of the wiring harness. This makes the assembly more complex, as a result of which the costs are also increased. Furthermore, dedicated pressure sensors are always associated with a certain risk of failure.

As an alternative, methods are known in the prior art, which permit a control of the fuel delivery system without dedicated pressure sensors. The methods determine an operating mode of the fuel delivery pump which is advantageous for the respective operating situation from characteristic variables detected during the operation of the fuel delivery system, with the aid of characteristic diagrams. To this end, for example, the actuating current of the electric motor of the fuel delivery pump and/or the rotational speed of the fuel delivery pump are/is monitored.

It is a disadvantage of said methods, in particular, that the control of the fuel delivery pump is not optimum, since the determination of the operating mode is often CPU-intensive, and the characteristic variables which are available for the determination are in part not optimum. Furthermore, methods of this type are based on the assumption that the fuel delivery system in the motor vehicle acts like a hydraulic orifice, the consumption quantity of the internal combustion engine being proportional to the orifice opening. This is often not the case in reality, however.

SUMMARY OF THE INVENTION

It is therefore an aspect of the present invention is to provide a method that provides an improved control of the fuel delivery system and, in particular, of the fuel delivery pump possible, no pressure sensor being used in the fuel delivery system. Furthermore, an aspect of the invention is to provide a method that can be applied to as great a multiplicity as possible of different fuel delivery systems and to as broad an operating range as possible of fuel delivery systems.

One exemplary embodiment of the invention relates to a method for controlling a fuel delivery system of an internal combustion engine, having a fuel delivery pump that can be driven by an electric motor, the pressure that prevails in the fuel delivery system being determined by way of a volume difference between the fuel quantity delivered by the fuel delivery pump and the fuel requirement of the internal combustion engine and/or of the fuel delivery system.

The fuel delivery pump delivers both the fuel quantity required for the operation of the internal combustion engine and the fuel quantity required for the operation of secondary pumps, such as suction jet pumps. The pressure that prevails in the fuel delivery system can be determined with a knowledge of the fuel delivery system and of the system behavior in the case of different ratios between the fuel delivery quantity and the fuel consumption quantity formed by way of the fuel requirement of the internal combustion engine and the fuel requirement for operating the secondary pumps. In an ideal consideration, merely the fuel requirement of the internal combustion engine is assessed in relation to the delivery quantity of the fuel delivery pump. In a real application, however, the fuel requirement is as a rule, as described above, supplemented by the fuel quantity which is required for operating the suction jet pumps. As a result, the pressure in the fuel delivery system rises somewhat, since an additional pressure loss is produced by way of the suction jet pump and other possibly present consumers. A slightly higher pre-delivery pressure is required as a result.

The pressure loss can be compensated for by way of an increase in the pump rotational speed, since the fuel delivery quantity is increased by way of the increase in the pump rotational speed and the pressure rises slightly at the same time, as a result of which the additional hydraulic losses can be compensated for.

It is particularly advantageous if a calibration is carried out to determine the pressure that prevails in the fuel delivery system, an operating point being set for calibration purposes, at which operating point the fuel requirement of the internal combustion engine is identical to the fuel quantity delivered by way of the fuel delivery pump, a pressure that is known in advance prevailing in the fuel delivery system at the calibration point.

Although a pressure change can be determined by way of the consideration of the difference between the fuel quantity delivered by way of the fuel delivery pump and the fuel requirement produced by way of the internal combustion engine, the absolute pressure value cannot be determined, since an initial pressure level has to be defined to this end. This is advantageously achieved by way of a calibration of the fuel delivery system at a calibration point. The calibration point is advantageously defined by the fact that the fuel quantity delivered by the fuel delivery pump and the fuel requirement of the internal combustion engine are of equal magnitude. In order to make an even more precise calibration possible, the fuel requirement for operating the suction jet pumps in the fuel delivery system can also be added, in addition to the fuel requirement of the internal combustion engine.

An initial value for the pressure in the fuel delivery system can be fixed by way of an operation of the fuel delivery system at said calibration point, starting from which initial value the pressure can be determined at every time and in every operating state. On account of the knowledge of the respective fuel delivery system, the pressure that prevails at the calibration point is in each case known in advance and can preferably be stored in one of the control units. The pressure can be determined empirically, for example, or can be calculated by way of simulations. The pressure might also be determined using an exemplary comparative system having a pressure sensor. Each individual fuel delivery system has, in its respective configuration, a different pressure level at the calibration point.

It is also advantageous if, starting from the calibration point, the change in the pressure is determined in a manner dependent on the fuel quantity delivered by way of the fuel delivery pump. This is possible in a particularly simple way, since the pressure in the fuel delivery system changes predictably. For instance, the pressure increases in the case of an increase in the fuel delivery quantity and a constant consumption quantity. Conversely, the pressure is reduced in the case of a falling fuel delivery quantity and a likewise constant consumption quantity.

There is preferably a calibration point for each consumption quantity and each fuel delivery quantity, which calibration point represents a defined pressure that is known in advance in the fuel delivery system.

One preferred exemplary embodiment is distinguished by the fact that the prevailing pressure in the fuel delivery system is determined within a predefinable operating range of the fuel delivery pump in a manner dependent on a change in the fuel delivery quantity, starting from the fuel delivery quantity at the calibration point.

This is particularly advantageous, since, starting from the pressure level at the calibration point, there is a known dependence that is specific for the respective fuel delivery system between the fuel delivery quantity and the pressure in the fuel delivery system. In addition, the respective consumption quantity of the fuel is to be taken into consideration, which consumption quantity consists of the fuel requirement of the internal combustion engine and the fuel quantity which is possibly required for the operation of suction jet pumps. The fuel delivery quantity which is required for the operation of suction jet pumps is as a rule considerably lower than the fuel requirement of the internal combustion engine, with the result that a very accurate result is achieved in a first approximation, even if the fuel quantity required for the operation of the suction jet pump is disregarded.

It is also to be preferred if a characteristic diagram is used to determine the pressure, the characteristic diagram generating a relationship between the fuel quantity delivered by way of the fuel delivery pump, the fuel requirement of the internal combustion engine and/or of the fuel delivery system, and the pressure that prevails in the fuel delivery system.

A characteristic diagram of this type or a plurality of characteristic diagrams of this type can be determined in a simple way by way of empirical tests or by way of a calculation for a respectively known fuel delivery system. The characteristic diagrams can be stored in the control units used for controlling and regulating the fuel delivery system. In this way, a very accurate determination of the pressure in the fuel delivery system can be achieved using simple means.

Moreover, it is advantageous if the curves of the characteristic diagram which is used to determine the pressure in the fuel delivery system form a straight line with a high ascending gradient for each fuel requirement of the internal combustion engine within a defined pressure range.

In particular, fuel delivery systems that have a wide range of curves which are configured as steeply running straight lines in the relevant characteristic diagrams can advantageously be operated via the method according to the invention. To this end, the characteristic diagrams have the fuel delivery quantity on the X-axis, whereas the pressure which prevails in the fuel delivery system is plotted on the Y-axis. Finally, the fuel consumption quantity is plotted in the characteristic diagram. In the characteristic diagram, the respective curves for the fuel consumption quantities preferably form a straight line with a steep gradient over a broad range, as a result of which in each case one region is generated that allows a precise statement about the respectively prevailing pressure. This is due to the fact that a linear pressure increase and pressure decrease can be assumed along said region configured as a straight line.

Furthermore, it is advantageous if, starting from the pressure at the calibration point, the pressure in the fuel delivery system rises in the case of an increase in the fuel quantity delivered by way of the fuel delivery pump, at a constant fuel requirement of the internal combustion engine. This is due to the fact that a fuel quantity is delivered that cannot be consumed completely by the internal combustion engine, as a result of which ultimately the pressure in the fuel delivery system rises. Fuel delivery systems which do not have any pressure relief valves or other apparatuses for pressure reduction exhibit a behavior of this type.

It is also expedient if, starting from the pressure at the calibration point, the pressure in the fuel delivery system drops in the case of a reduction in the fuel quantity delivered by way of the fuel delivery pump, at a constant fuel requirement of the internal combustion engine. This is due to the fact that the fuel requirement is in practice higher than the fuel quantity delivered by the fuel delivery pump.

Moreover, it is advantageous if a value for the fuel requirement of the internal combustion engine is provided by a control unit of the internal combustion engine. In modern fuel injection systems and internal combustion engines, the respectively required fuel and the consumed fuel are as a rule known very accurately on account of the complexity of the combustion. The value for the fuel requirement can therefore be provided at a high quality without additional complexity by one of the control units that controls the combustion in the internal combustion engine.

Furthermore, it is expedient if the fuel quantity, which is delivered by the fuel delivery pump, is determined via a flow meter, or is determined computationally from the rotational speed of the fuel delivery pump, or is determined from the current, with which the fuel delivery pump is actuated. It is particularly advantageous if no additional physical apparatus is required for determining the fuel quantity, which is delivered by the fuel pump, in order for the fuel delivery system to be of as simple configuration as possible.

Advantageous developments of the present invention are described in the subclaims and in the following description of the figures.

BRIEF DESCRIPTION OF THE DRAWINGS

In the following text, the invention will be described in detail using exemplary embodiments, with reference to the drawings, in which.

DETAILED DESCRIPTION OF THE PREFERRED EMBODIMENT

Figure 1:
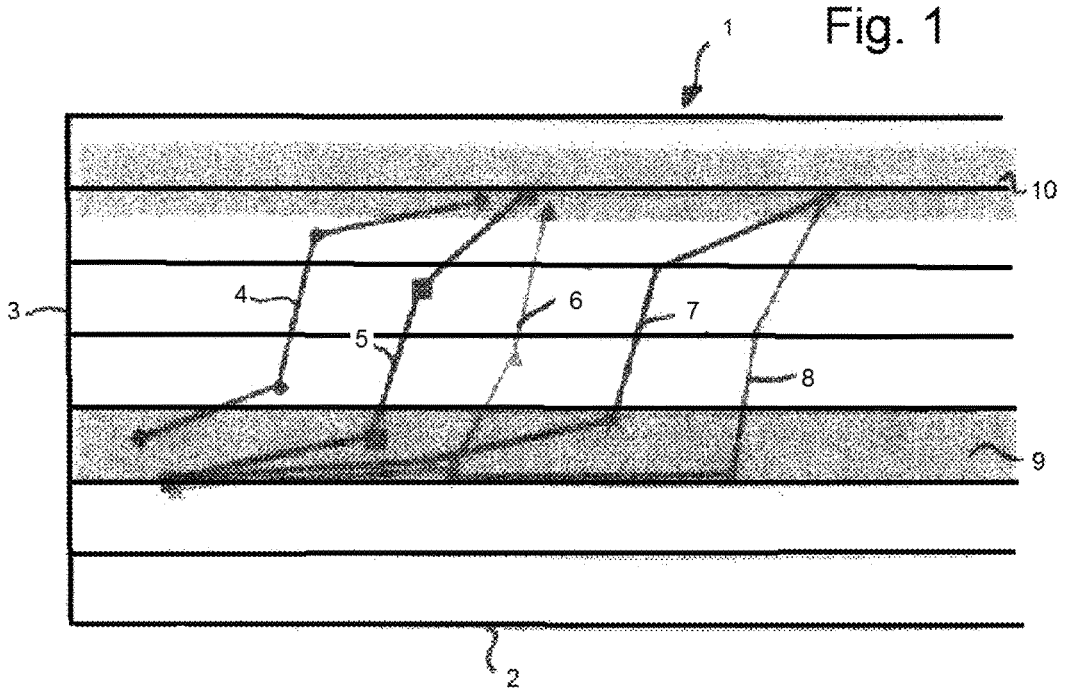
FIG. 1 is a of fuel consumption by an internal combustion engine plotted against a fuel delivery quantity of the fuel delivery pump.

FIG. 1 shows a graph 1. In the graph 1, the fuel delivery quantity of a fuel delivery pump in a fuel delivery system is plotted on the X-axis 2. Here, the fuel delivery quantity is plotted for a range from zero liters per hour at the point of intersection with the Y-axis 3 up to 80 liters per hour on the right-hand end region of the X-axis 2. The pressure that prevails in the fuel delivery system is plotted on the Y-axis 3. The curves 4, 5, 6, 7, and 8 represent the respective fuel requirement of an internal combustion engine. The curve 4 corresponds to a fuel requirement of 20 liters per hour, the curve 5 corresponds to a fuel requirement of 30 liters per hour, the curve 6 corresponds to a fuel requirement of 40 liters per hour, the curve 7 corresponds to a fuel requirement of 50 liters per hour, and the curve 8 corresponds to a fuel requirement of 60 liters per hour. The fuel requirements of the graph 1 are by way of example and represent values for a specific fuel delivery system for an internal combustion engine. The respective diagrams will also look similar in terms of the quality, however, for other fuel requirements in differing fuel delivery systems.

It can be seen from the curves 4 to 8 that a pressure, which is constant across the fuel requirements 4 to 8, prevails in the fuel delivery system in each case in the case of a match of the fuel requirement 4 to 8 and the fuel delivery quantity on the X-axis 2. The pressure is set when, for example, 20 liters per hour are delivered by the fuel delivery pump and the fuel requirement of the internal combustion engine is likewise 20 s per hour. The substantially constant pressure is dependent on the respective fuel delivery system and can correspondingly be somewhat higher or lower. In the example of FIG. 1, the constant pressure for a fuel delivery system that forms the basis for the curves 4 to 8 is approximately 4 bar.

In the case of a fuel requirement that lies considerably above the fuel delivery quantity, the pressure in the fuel delivery system drops greatly. This can be seen in the region 9 of FIG. 1. In the case of a fuel requirement below the fuel delivery quantity, in contrast, the pressure rises. This can be seen in the region 10.

The curves 4 to 8 result from a simulation and show values for a defined fuel delivery system. Here, this is, in particular, a fuel delivery system that does not act as a hydraulic orifice. Therefore, the fuel consumption quantity of the internal combustion engine is not proportional to the hydraulic orifice formed by way of the fuel delivery system. Depending on the operating mode, the high pressure pump connected downstream of the fuel delivery system and delivers the fuel to the internal combustion engine can contribute to a different appearance of the characteristic diagrams. The basic statement that a constant pressure is set in the fuel delivery system if the fuel consumption quantity coincides with the fuel quantity delivered by way of the fuel delivery system remains unaffected by this, however.

Figure 2:
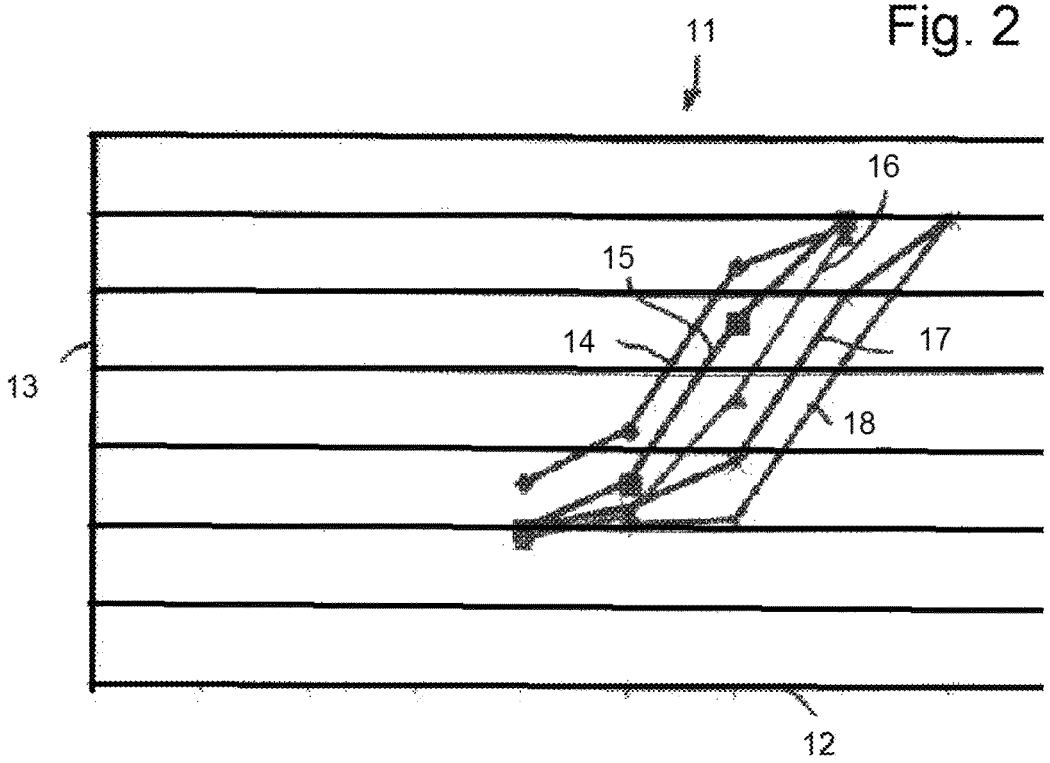
FIG. 2 is a graph of fuel consumption by the internal combustion engine plotted against rotational speed of the fuel delivery pump.

FIG. 2 shows an alternative illustration of the graph 1 from FIG. 1, the fuel requirements 14, 15, 16, 17 and 18 of the internal combustion engine being plotted against the rotational speed of the fuel delivery pump plotted along the X-axis 12. The pressure in the fuel delivery system is plotted on the Y-axis 13 of the diagram 11. Since the rotational speed of the fuel delivery pump is directly linked to the delivery quantity of the fuel delivery pump, the two diagrams 1, are directly dependent on one another and differ substantially merely by way of a different illustration.

It can be derived from the graphs 1 and 11 of FIGS. 1 and 2 that in each case the change in the delivered fuel quantity in the case of a constant fuel consumption by way of the internal combustion engine leads to a change in the pressure in the fuel delivery system. Via the characteristic diagrams, which are formed by way of the diagrams 1 and 11, therefore, the increase and the decrease in the pressure can be determined in a manner dependent on the respectively delivered fuel quantity and the respective fuel requirement of the internal combustion engine. In order to also obtain a statement about an absolute pressure value, a calibration of the fuel delivery system has to take place. Said calibration takes place by way of a defined calibration point being set that is distinguished by the fact that the delivered fuel quantity coincides with the fuel quantity consumed by the internal combustion engine. A defined pressure prevails in the fuel delivery system at said calibration point, which defined pressure can be used as an initial value for the pressure. The changes in the pressure which can be detected by the characteristic diagrams can therefore be translated at any time into an absolute pressure.

A substantially constant pressure value can be determined for every fuel delivery system by way of a calibration, which pressure value is used as a starting basis for the pressure determination. Furthermore, the pressure can also be calculated using what is known as a gradient function in the case of a defined consumption quantity in the fuel delivery system. This can take place, for example, by way of a consideration of the different gradients in the case of different fuel volumes that are delivered. The calibrated base value can be stored in a control unit of the fuel delivery system, with the result that a precise determination of the pressure which prevails in the fuel delivery system is possible at every operating time.

A reliable starting basis for volume-based calculations, such as the throughflow control or the throughflow monitoring, is obtained as a by-product of the setting of an operating point, at which the fuel consumption by way of the internal combustion engine and the fuel delivery quantity of the fuel delivery pump coincide. Furthermore, the aging of the fuel delivery pump and the therefore slowly dropping fuel delivery volume can also be compensated for in this way.

Figure 3:
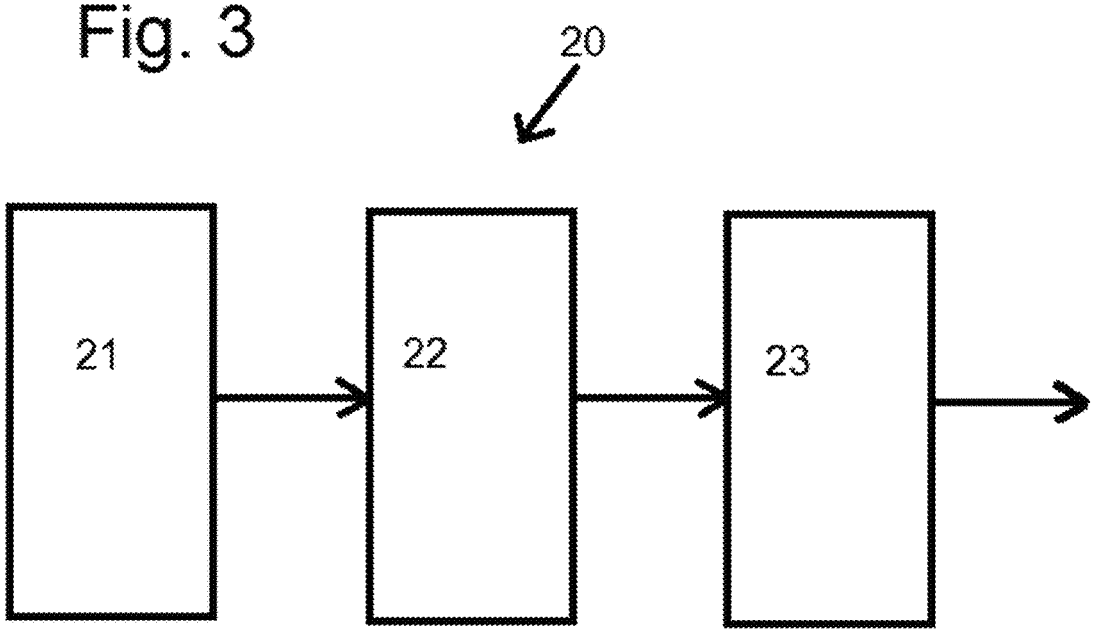
FIG. 3 is a block diagram of the method.

FIG. 3 shows a block diagram 20, the block diagram 20 depicting the method according to the invention by way of example. A calibration of the fuel delivery system takes place in the block 21, by a defined operating point being set, which is distinguished by the fact that the fuel consumption by way of the internal combustion engine and the fuel delivery quantity of the fuel delivery pump correspond to one another. The step can also take place for a specific fuel delivery system empirically in advance or on the basis of a calculation. The pressure that prevails at the calibration point is read into a control unit of the fuel delivery system and is stored as a base value. Starting from said base value, a pressure change can be detected in the block 22 with the observation of the change in the fuel delivery quantity and/or the fuel consumption by way of the internal combustion engine. In the block 23, the respectively prevailing pressure in the fuel delivery system is determined by way of the combination of the initial value for the pressure in the fuel delivery system and the pressure change.

The exemplary embodiments of FIGS. 1 to 3 do not have a restrictive character, in particular, and serve to illustrate the concept of the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for controlling a fuel delivery system of an internal combustion engine, having a fuel delivery pump that is driven by an electric motor, comprising:

determining a volume difference between a fuel quantity delivered by the fuel delivery pump and a fuel requirement of the internal combustion engine and the fuel delivery system; and determining a pressure that prevails in the fuel delivery system is determined based on the volume difference between the fuel quantity which is delivered by the fuel delivery pump and the fuel requirement of the internal combustion engine and at least one suction jet pump of the fuel delivery system.

2. A method for controlling a fuel delivery system of an internal combustion engine, having a fuel delivery pump that is driven by an electric motor, comprising:

determining a volume difference between a fuel quantity delivered by the fuel delivery pump and a fuel requirement of at least one of the internal combustion engine and the fuel delivery system;

determining a pressure that prevails in the fuel delivery system is determined based on the volume difference between the fuel quantity which is delivered by the fuel delivery pump and the fuel requirement of at least one of the internal combustion engine and the fuel delivery system;

performing a calibration to determine the pressure that prevails in the fuel delivery system; and setting an operating point for calibration purposes at which operating point the fuel requirement of the internal combustion engine is substantially identical to the fuel quantity delivered by the fuel delivery pump, wherein a known pressure prevails in the fuel delivery system at the operating point for calibration.

3. The method as claimed in claim 2, wherein, starting from the calibration point, a change in the pressure is determined in a manner dependent on a fuel quantity delivered by the fuel delivery pump.

4. The method as claimed in claim 2, wherein the pressure in the fuel delivery system is determined within a predefinable operating range of the fuel delivery pump based at least in part on a change in the fuel delivery quantity, starting from the fuel delivery quantity at the calibration point.

5. The method as claimed in claim 2, wherein a characteristic diagram is used to determine the pressure, the characteristic diagram providing a relationship between the fuel quantity delivered by way of the fuel delivery pump, the fuel requirement of the at least one of the internal combustion engine and the fuel delivery system, and the pressure that prevails in the fuel delivery system.

6. The method as claimed in claim 5, wherein curves of the characteristic diagram used to determine the pressure in the fuel delivery system form a straight line with a high ascending gradient for each fuel requirement of the internal combustion engine within a defined pressure range.

7. The method as claimed in claim 2, wherein, starting from the pressure at the calibration point, the pressure in the fuel delivery system rises in a case of an increase in the fuel quantity delivered by way of the fuel delivery pump, at a constant fuel requirement of the internal combustion engine.

8. The method as claimed in claim 2, wherein, starting from the pressure at the calibration point, the pressure in the fuel delivery system drops in a case of a reduction in the fuel quantity delivered by way of the fuel delivery pump, at a constant fuel requirement of the internal combustion engine.

9. The method as claimed in claim 2, wherein a value for the fuel requirement of the internal combustion engine is provided by a control unit of the internal combustion engine.

10. The method as claimed in claim 2, wherein the fuel quantity delivered by the fuel delivery pump is determined via one of:

a flow meter, computationally from a rotational speed of the fuel delivery pump, or from a current with which the fuel delivery pump is actuated.

* * * * *